US009857752B2

(12) United States Patent
Nishi et al.

(10) Patent No.: US 9,857,752 B2
(45) Date of Patent: Jan. 2, 2018

(54) IMAGE FORMING APPARATUS THAT PURGES SHEETS AFTER A PAPER JAM

(71) Applicant: KONICA MINOLTA, INC., Chiyoda-ku, Tokyo (JP)

(72) Inventors: Youichirou Nishi, Hino (JP); Hiroyuki Konishi, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/572,483

(22) Filed: Dec. 16, 2014

(65) Prior Publication Data

US 2015/0168907 A1 Jun. 18, 2015

(30) Foreign Application Priority Data

Dec. 16, 2013 (JP) ..... 2013-259462

(51) Int. Cl.
*G03G 15/00* (2006.01)
*B65H 29/60* (2006.01)
(Continued)

(52) U.S. Cl.
CPC ..... *G03G 15/70* (2013.01); *B65H 29/60* (2013.01); *B65H 31/24* (2013.01); *B65H 43/00* (2013.01);
(Continued)

(58) Field of Classification Search
CPC ..... G03G 15/70; G03G 2215/00548; G03G 2215/00552
(Continued)

(56) References Cited

U.S. PATENT DOCUMENTS 5,532,793 A 7/1996 Kogure et al.
6,078,760 A * 6/2000 Abe ..... G03G 15/2064 399/322
(Continued)

FOREIGN PATENT DOCUMENTS

JP 07120984 A 5/1995
JP 11292389 A 10/1999
(Continued)

OTHER PUBLICATIONS

Extended European Search Report (EESR) dated Jul. 27, 2015, issued in counterpart European Application No. 14198149.8.
(Continued)

*Primary Examiner* — Justin Olamit
(74) *Attorney, Agent, or Firm* — Holtz, Holtz & Volek PC

(57) ABSTRACT

Disclosed is an image forming system, which makes it possible to effectively eject the jam-subsequent paper sheet remaining therein. In the system, a primary abnormal state in which the conveyance operation cannot be continued, and a secondary abnormal state in which an adverse influence is possibly incurred to the image formed on the paper sheet though it is possible to continue the conveyance operation, are defined. In the state that the primary abnormal state or the secondary abnormal state is detected in midcourse of the conveyance operation, when a pre-purge processing for conveying the jam-subsequent paper sheet is implemented so as to eject the jam-subsequent paper sheet onto the ejecting tray, controlling operations are conducted so as to continue the conveyance operation without halting the conveyance operation, even if the secondary abnormal state in respect to the jam-subsequent paper sheet is detected in midcourse of performing the pre-purge processing thereof.

17 Claims, 7 Drawing Sheets

(51) Int. Cl.
*B65H 31/24* (2006.01)
*B65H 43/00* (2006.01)

(52) U.S. Cl.
CPC ..... *G03G 15/55* (2013.01); *B65H 2511/528* (2013.01); *B65H 2513/42* (2013.01); *G03G 15/5012* (2013.01); *G03G 2215/00548* (2013.01); *G03G 2215/00552* (2013.01); *G03G 2221/1696* (2013.01)

(58) Field of Classification Search
USPC ..... 399/20
See application file for complete search history.

(56) References Cited

U.S. PATENT DOCUMENTS 7,228,079 B2 * 6/2007 Brown et al. ..... 399/21
7,636,543 B2 * 12/2009 Mandel ..... B65H 19/18 399/407
8,342,517 B2 * 1/2013 Kinoshita ..... B65H 9/002 271/226
8,355,642 B2 * 1/2013 Shoji et al. ..... 399/20
8,363,233 B2 * 1/2013 Yamada ..... G03G 15/5016 358/1.13
2003/0190169 A1 10/2003 Shibaki
2008/0175607 A1 * 7/2008 Willis ..... 399/20
2009/0310983 A1 12/2009 Shoji et al.
2010/0119244 A1 5/2010 Kitagawa

FOREIGN PATENT DOCUMENTS

JP 2003280304 A 10/2003
JP 2006343727 A 12/2006
JP 2008052125 A 3/2008
JP 2009042402 A 2/2009

OTHER PUBLICATIONS

Japanese Office Action (and English translation thereof) dated Nov. 17, 2015, issued in counterpart Japanese Application No. 2013-259462.

* cited by examiner

IMAGE FORMING APPARATUS THAT PURGES SHEETS AFTER A PAPER JAM

Under 35 U.S.C. §119, we claim Paris Convention Priority of this application based on Japanese Patent Application No. 2013-259462 filed on Dec. 16, 2013 with the Japan Patent Office. Accordingly, the entire content of Japanese Patent Application No. 2013-259462 is hereby incorporated by reference.

BACKGROUND OF THE INVENTION

Field of the Invention

The present invention relates to a copier, a printer, an image forming apparatus, such as an MFP (Multi-Functional Peripheral) incorporating a copier and a printer, etc., and an image forming system in which an image forming apparatus and a post processing apparatus and/or the like are coupled to each other.

Description of Related Art

Generally speaking, an image forming apparatus, such as a copier, a printer, etc., is provided with a plurality of paper sheet feeding trays, which accommodate plural kinds of paper sheets respectively therein, in order to cope with various kinds of printing conditions. Further, in order to individually cope with a huge variety of printed paper sheets, sometimes, a single or a plurality of post processing apparatus that applies various kinds of processing to paper sheets on which images are already formed, may be cascaded to the image forming apparatus as the post processing stage thereof, so as to configure a structural configuration of an image forming system.

Further, in such a case where various kinds of post processing apparatuses or the like are coupled to the image forming apparatus as above-mentioned, sometimes, a plurality of ejecting trays, respectively corresponding to the various kinds of post processing, may be provided in the image forming system. In this connection, according to the conventionally existing technology, in case that a paper jam failure has occurred at a certain position within the image forming system, after the operation of the image forming system has been made to halt, a single or a plurality of jam-subsequent paper sheets is collected onto a specific tray to make them eject from the image forming system as a purge processing.

Incidentally, with respect to operations for handling the jam-subsequent paper sheets, various kinds of Patent Documents, including Japanese Patent Application Laid-Open Publication No. 2008-052125 (hereinafter, referred to as Document 1), Japanese Patent Application Laid-Open Publication No. 2006-343727 (hereinafter, referred to as Document 2), Japanese Patent Application Laid-Open Publication No. 2003-280304 (hereinafter, referred to as Document 3), Japanese Patent Application Laid-Open Publication No. Tokkaihei 11-292389 (hereinafter, referred to as Document 4), Japanese Patent Application Laid-Open Publication No. Tokkaihei 07-120984 (hereinafter, referred to as Document 5), etc., set forth various kinds of technologies, respectively.

According to Document 1 above-cited, at the time when a paper jam has occurred, with respect to a paper sheet that is located upstream from the jam-causing paper sheet and can be conveyed to any one of the ejecting destinations, the conveying operation thereof is to be continued, so as to eject the paper sheet therefrom as the pre-purge processing. On the other hand, with respect to another paper sheet that cannot be ejected, the purge processing is applied thereto, after the jam-causing paper sheet (defined as a paper sheet at which the concerned paper jam has occurred) has been removed.

According to Document 2 above-cited, at the time when a paper jam has occurred, instead of halting the operations for conveying all of the paper sheets currently residing within the apparatus as a whole, only the operation for conveying the jam-causing paper sheet is halted. Then, the operation for conveying a paper sheet, other than the jam-causing paper sheet and remaining within the apparatus, is continued, so as to eject the paper sheet as the pre-purge processing.

According to Document 3 above-cited, at the time when a paper jam has occurred within the image forming apparatus main-body, provided that a jam occurrence position is located upstream from the insertion merging point of the insertion paper sheet, the current operation of the image forming apparatus is deactivated, immediately after the insertion paper sheet has been swept out.

According to Document 4 above-cited, at the time when a paper jam has occurred at a certain position within the image forming system, jam-subsequent paper sheets currently remaining within the image forming system are collected onto a specific one of the ejecting tray, which is selectable by the user, to eject them therefrom.

According to Document 5 above-cited, at the time when a paper jam has occurred at the reciprocal conveyance duplex unit, a paper sheet on both sides of which duplex images are already formed is to be ejected, while another paper sheet on one side of which an image is already formed is conveyed to the standby position (reverse position) located upstream from the jam-causing paper sheet.

In this connection, hereinafter in an image forming apparatus or an image forming system, such a state that an operation for conveying a paper sheet is disabled due to a paper jam currently occurring at any one of the various conveyance sections, is defined as a primary abnormal state. Further, in the primary abnormal state above-defined, the image forming apparatus or the image forming system recognizes an occurrence of a primary paper jam, and the control section thereof conducts controlling operations for halting the conveyance operation of the paper sheet concerned.

Further, hereinafter in an image forming apparatus or an image forming system, such an abnormal state, in which a certain negative influence would be possibly given to the image quality, such as an inclination of an image formed on the paper sheet, a dropout of an image to be formed on the paper sheet, or the like, due to an abnormality of the paper sheet conveyance operation, such as the inclined conveyance, the leaning conveyance to one side, the duplicate conveyance, etc., is defined as a secondary abnormal state.

In the meantime, in a case where a paper jam has occurred at a jam-causing paper sheet, and the pre-purge processing is to be applied to a jam-subsequent paper sheet located upstream from the jam-causing paper sheet, sometimes, another paper jam may occur at the jam-subsequent paper sheet in midcourse of applying the pre-purge processing thereto.

For instance, at the time when a paper jam has occurred due to the fact that a concerned paper sheet is jammed with a pair of conveyance rollers located at a certain position, jam-subsequent paper sheets reside at various kinds of positions, such as a position in the vicinity of a paper sheet feeding section, a position in the vicinity of a toner image transferring point, etc., which is located upstream from the position of the jam-causing paper sheet.

Accordingly, in the above-mentioned case, owing to various kinds of adverse factors, including a leaning or inclination of a paper sheet residing in the vicinity of a toner image transferring point, a duplicate conveyance performed by the paper sheet feeding section, a delay of timing for feeding a paper sheet residing at a pair of paper sheet feeding rollers or a resist roller, etc., even the jam-subsequent paper sheet may be possibly jammed in midcourse of applying the pre-purge processing thereto.

In this connection, in an image forming apparatus for production printing use, which has been increasingly proliferated in the market of the high-speed mass-production printing (image forming operation) in recent years, a plurality of paper sheet feeding apparatuses may be coupled to the image forming apparatus concerned, and as a result, the length of the conveyance path is liable to become longer than ever. In this case, when the jam-subsequent paper sheet has further jammed in the vicinity of a toner image transferring point in midcourse of applying the pre-purge processing thereto, none of an ejecting path or a tray is provided for conveying and ejecting another jam-subsequent paper sheet, remaining at a position upstream therefrom, in the vicinity of the paper sheet feeding section or the image forming section.

In other words, arisen is a new problem that it becomes difficult for the image forming apparatus of production printing use to cope with a certain abnormality generated in the jam-subsequent paper sheet in midcourse of applying the pre-purge processing thereto. However, none of Documents 1 through 5 set forth a technology for providing a countermeasure to cope with the above-mentioned problem, and so far, it has been impossible to eject the jam-subsequent paper sheet effectively.

SUMMARY OF THE INVENTION

To overcome the abovementioned drawbacks in conventional image forming apparatuses, it is one of objects of the present invention to provide an image forming apparatus, an image forming system and a method for controlling image forming operations, each of which makes it possible to effectively eject the jam-subsequent paper sheet remaining within an image forming apparatus and/or a post processing apparatus when a certain trouble, such as a paper jam, etc., has occurred.

Accordingly, at least one of the objects of the present invention can be attained by at least one of the image forming apparatuses, the image forming systems and the methods for controlling the same, which are described as follows.

(1) According to an image forming apparatus or an image forming system, reflecting an aspect of the present invention, the image forming apparatus or the image forming system comprises: an image forming section that forms an image onto a paper sheet; a conveyance section that conveys the paper sheet; an ejecting section that ejects the paper sheet onto an ejecting tray; an abnormality detecting section that detects a primary abnormal state in which the conveyance section is incapable of continuing an operation for conveying the paper sheet, and a secondary abnormal state in which a certain influence is possibly incurred to the image formed on the paper sheet though the conveyance section is capable of continuing an operation for conveying the paper sheet; and a control section that conducts controlling operations for conveying the paper sheet in accordance with an image forming operation performed by the image forming section, so as to eject the paper sheet onto the ejecting tray of the ejecting section; wherein, in a case where the abnormality detecting section detects the primary abnormal state or the secondary abnormal state in midcourse of the operation for conveying the paper sheet, the paper sheet, detected as in the primary abnormal state or in the secondary abnormal state, is defined as a jam-causing paper sheet, while, another paper sheet, remaining upstream from the jam-causing paper sheet, is defined as a jam-subsequent paper sheet; and wherein the control section controls both the conveyance section and the ejecting section to implement a pre-purge processing for conveying the jam-subsequent paper sheet so as to eject the jam-subsequent paper sheet onto the ejecting tray; and wherein, in a case when the secondary abnormal state in respect to the jam-subsequent paper sheet is detected by the abnormality detecting section in midcourse of performing the pre-purge processing thereof, the control section controls the conveyance section to continue the operation for conveying the paper sheet without halting the operation for conveying the paper sheet.

(2) According to another aspect of the present invention, in the image forming apparatus or the image forming system, recited in item 1, in a case when the primary abnormal state in respect to the jam-subsequent paper sheet is detected by the abnormality detecting section in midcourse of performing the pre-purge processing thereof, the control section controls the conveyance section and the ejecting section to halt the operation for conveying the paper sheet without continuing the operation for conveying the paper sheet.

(3) According to still another aspect of the present invention, in the image forming apparatus or the image forming system, recited in item 1 or 2, in a case when the jam-subsequent paper sheet ejected in the pre-purge processing is to be utilized, when the secondary abnormal state in respect to the jam-subsequent paper sheet is detected by the abnormality detecting section in midcourse of performing the pre-purge processing thereof, the control section controls the conveyance section and the ejecting section to halt the operation for conveying the paper sheet without continuing the operation for conveying the paper sheet.

(4) According to still another aspect of the present invention, in the image forming apparatus or the image forming system, recited in item 3, the control section accepts a setting established by determining whether or not the jam-subsequent paper sheet ejected in the pre-purge processing is to be utilized.

(5) According to still another aspect of the present invention, the image forming apparatus or the image forming system, recited in any one of items 1-4, further comprises: a display section that displays various kinds of display screens thereon, based on a controlling operation conducted by the control section; wherein, in a case where the operation for conveying the paper sheet is to be continued due to a fact that the secondary abnormal state in respect to the jam-subsequent paper sheet is detected in midcourse of performing the pre-purge processing thereof, the control section controls the display section to display a message indicating that the operation for conveying the paper sheet is continued in the secondary abnormal state currently detected.

(6) According to still another aspect of the present invention, the image forming apparatus or the image forming system, recited in any one of items 1-5, the ejecting section is provided with a plurality of ejecting trays being independent from each other; and the control section controls the conveyance section and the ejecting section so that the paper sheet, in which neither the primary abnormal state nor the secondary abnormal state is detected, is ejected onto one of the plurality of ejecting trays, while the jam-subsequent paper sheet, which is to be conveyed in the pre-purge processing, is ejected onto another one of the plurality of ejecting trays.

(7) According to still another aspect of the present invention, the image forming apparatus or the image forming system, recited in any one of items 1-6, the primary abnormal state is defined as such a state that the paper sheet has jammed, while the secondary abnormal state is defined as such a state that the paper sheet is leaning to one side or is inclined during the operation for conveying the paper sheet, or the paper sheet and another paper sheet are conveyed in duplicate.

(8) According to a method, reflecting still another aspect of the present invention, for controlling operations to be performed in an image forming apparatus or an image forming system, which includes: an image forming section that forms an image onto a paper sheet; a conveyance section that conveys the paper sheet; an ejecting section that ejects the paper sheet onto an ejecting tray; an abnormality detecting section that detects a primary abnormal state in which the conveyance section is incapable of continuing an operation for conveying the paper sheet, and a secondary abnormal state in which a certain influence is possibly incurred to the image formed on the paper sheet though the conveyance section is capable of continuing an operation for conveying the paper sheet; and a control section that conducts controlling operations for conveying the paper sheet in accordance with an image forming operation performed by the image forming section, so as to eject the paper sheet onto the ejecting tray of the ejecting section; wherein, in a case where the abnormality detecting section detects the primary abnormal state or the secondary abnormal state in midcourse of the operation for conveying the paper sheet, the paper sheet, detected as in the primary abnormal state or in the secondary abnormal state, is defined as a jam-causing paper sheet, while, another paper sheet, remaining upstream from the jam-causing paper sheet, is defined as a jam-subsequent paper sheet, the method comprising the steps of: controlling both the conveyance section and the ejecting section to implement a pre-purge processing for conveying the jam-subsequent paper sheet so as to eject the jam-subsequent paper sheet onto the ejecting tray; and controlling the conveyance section to continue the operation for conveying the paper sheet without halting the operation for conveying the paper sheet, in a case where the secondary abnormal state in respect to the jam-subsequent paper sheet is detected by the abnormality detecting section in midcourse of performing the pr-purge processing thereof.

(9) According to still another aspect of the present invention, the method recited in item 8, further comprises the step of: controlling the conveyance section and the ejecting section to halt the operation for conveying the paper sheet without continuing the operation for conveying the paper sheet, when the primary abnormal state in respect to the jam-subsequent paper sheet is detected by the abnormality detecting section in midcourse of performing the pre-purge processing thereof.

(10) According to still another aspect of the present invention, in a case when the jam-subsequent paper sheet ejected in the pre-purge processing is to be utilized, the method recited in item 8 or 9 further comprises the step of: controlling the conveyance section and the ejecting section to halt the operation for conveying the paper sheet without continuing the operation for conveying the paper sheet, when the secondary abnormal state in respect to the jam-subsequent paper sheet is detected by the abnormality detecting section in midcourse of performing the pre-purge processing thereof.

(11) According to still another aspect of the present invention, the method recited in item 10 further comprises the step of: accepting a setting established by determining whether or not the jam-subsequent paper sheet ejected in the pre-purge processing is to be utilized.

(12) According to still another aspect of the present invention, in the method recited in any one of items 8-11, the image forming apparatus or the image forming system further includes a display section that displays various kinds of display screens thereon, based on a controlling operation conducted by the control section, and the method further comprises the step of: controlling the display section to display a message indicating that the operation for conveying the paper sheet is continued in the secondary abnormal state currently detected, in a case where the operation for conveying the paper sheet is to be continued due to a fact that the secondary abnormal state in respect to the jam-subsequent paper sheet is detected in midcourse of performing the pre-purge processing thereof.

(13) According to yet another aspect of the present invention, in the method recited in any one of items 8-12, the ejecting section is provided with a plurality of ejecting trays being independent from each other, the method further comprising the step of: controlling the conveyance section and the ejecting section, so that the paper sheet, in which neither the primary abnormal state nor the secondary abnormal state is detected, is ejected onto one of the plurality of ejecting trays, while the jam-subsequent paper sheet, which is to be conveyed in the pre-purge processing, is ejected onto another one of the plurality of ejecting trays.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF THE PREFERRED EMBODIMENT

Figure 1:
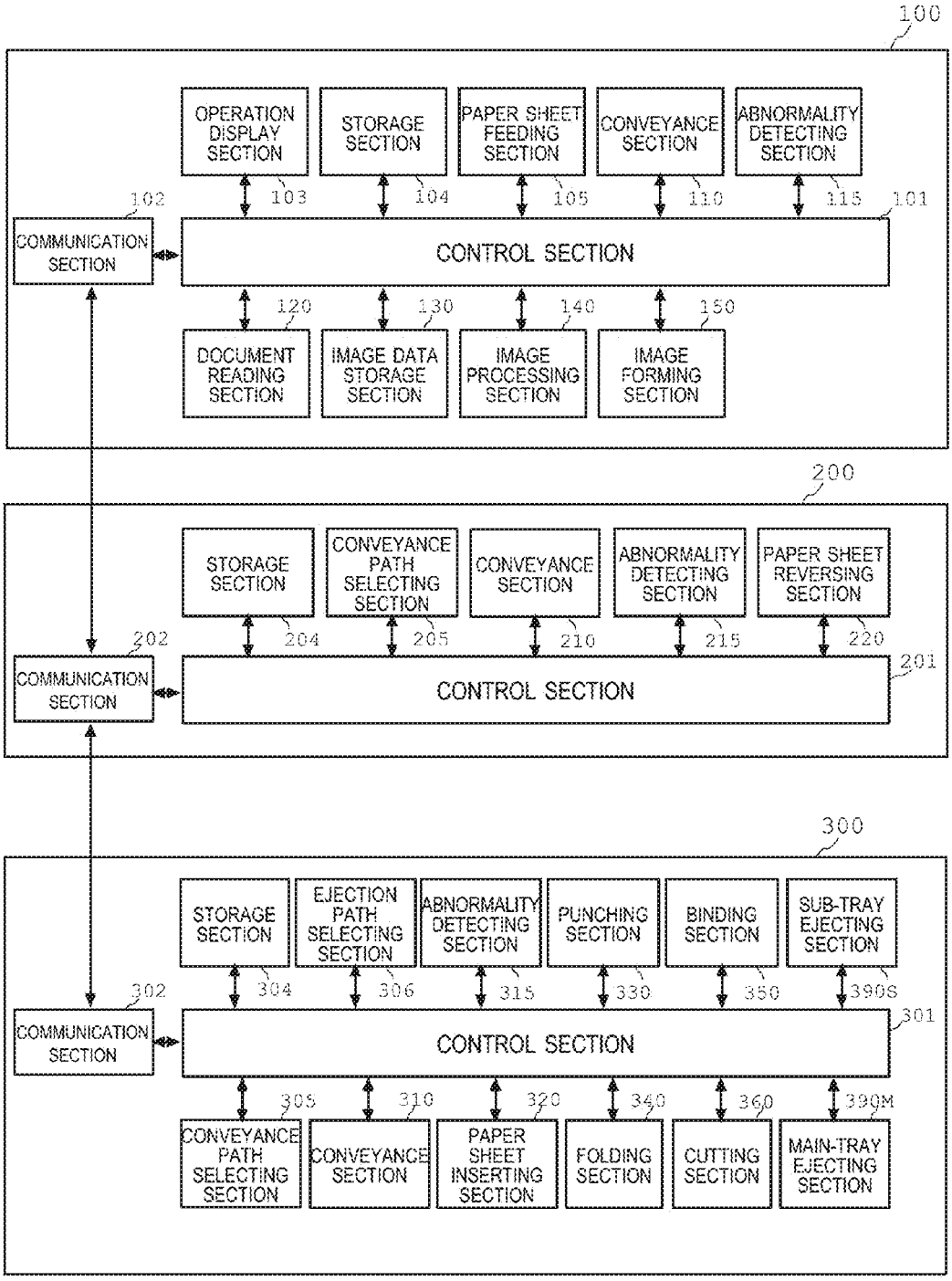
FIG. 1 is a block diagram indicating a configuration of image forming system in accordance with an embodiment of the present invention.

Referring to the drawings, an embodiment in accordance with the present invention (hereinafter, referred to as an embodiment) will be detailed in the following.

<Overall Configuration>

Figure 2:
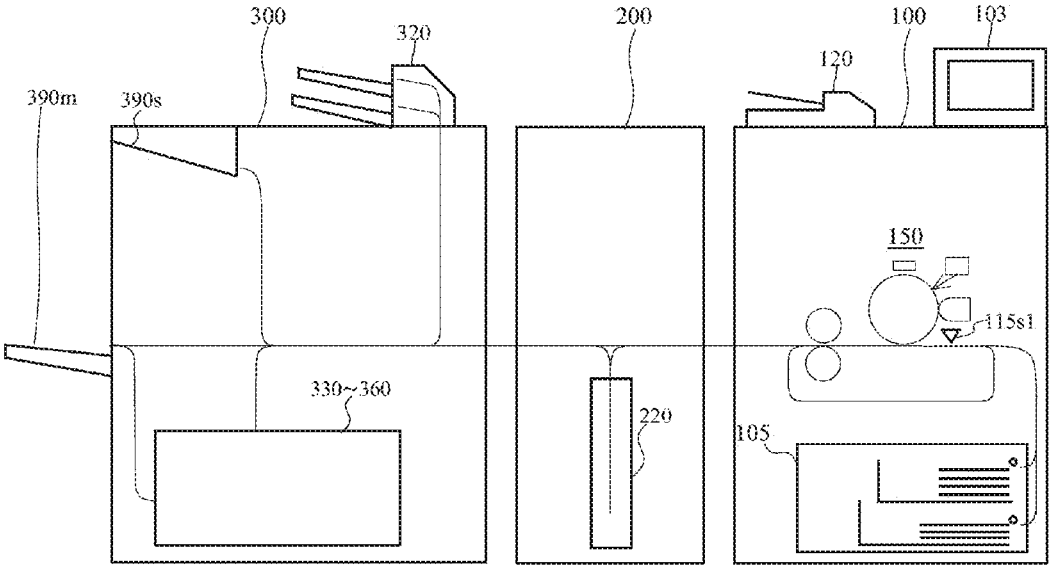
FIG. 2 is a schematic diagram showing a structural configuration of an image forming system in accordance with an embodiment of the present invention.
Figure 3:
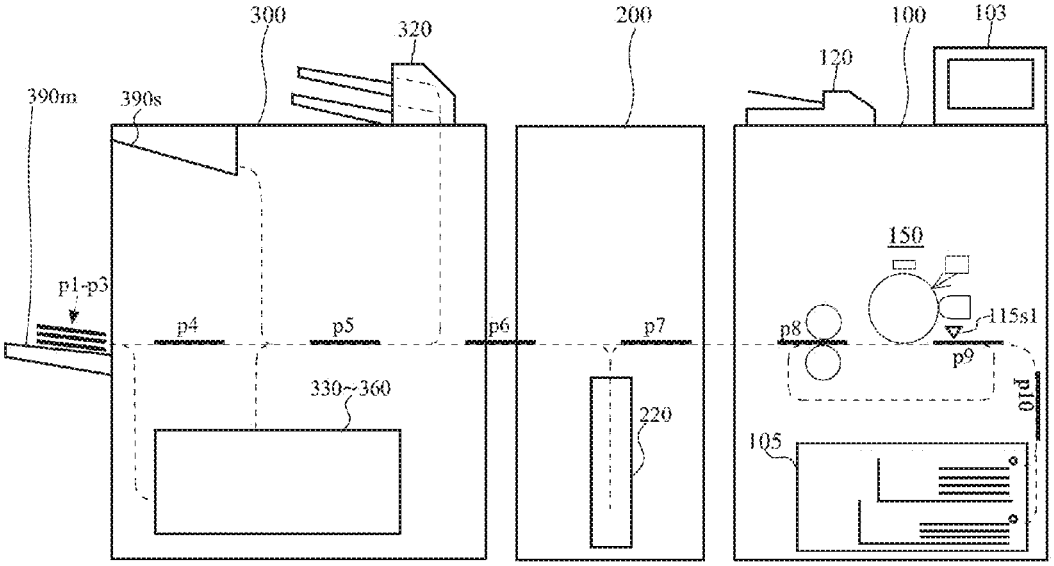
FIG. 3 is another schematic diagram showing a structural configuration of an image forming system in accordance with an embodiment of the present invention, indicating a flow of paper sheets currently conveyed therein.

Referring to FIG. 1 through FIG. 3, a configuration of an image forming system provided with an image forming apparatus and post processing apparatuses, both of which are in accordance with an embodiment of the present invention, will be detailed in the following.

In the block diagram shown in FIG. 1, the constituents included in the image forming apparatus or the image forming system are indicated as functional blocks, respectively. Further, in the schematic diagram shown in FIG. 2, a cross sectional structural arrangement of the various sections included in the image forming apparatus or the image forming system is schematically indicated. Still further, in the schematic diagram shown in FIG. 2, a cross sectional structural arrangement of the various sections included in the image forming apparatus or the image forming system and an exemplary conveyance status of the paper sheet are schematically indicated.

As indicated in the schematic diagrams shown in FIGS. 1-3, the image forming system includes an image forming apparatus 100, an intermediate apparatus 200 and a post processing apparatus 300. The image forming apparatus 100 forms an image on a paper sheet. The intermediate apparatus 200, serving as a subsequent stage of the image forming apparatus 100, reverses the paper sheet received therefrom. The post processing apparatus 300 applies various kinds of post processing to the paper sheet on which an image is already formed. Incidentally, the above-mentioned mode for coupling the concerned apparatuses to each other in the image forming system is merely an exemplified mode among various kinds of connection modes. Therefore, the scope of the present invention is not limited to the connection mode indicated by the drawings.

The image forming apparatus 100 is constituted by a control section 101, a communication section 102, an operation display section 103, a storage section 104, a paper sheet feeding section 105, a conveyance section 110, an abnormality detecting section 115, a document reading section 120, an image data storage section 130, an image processing section 140 and an image forming section 150.

The control section 101 controls not only operations to be performed by the various kinds of sections within the image forming apparatus 100, but also overall operations to be implemented in the system as a whole, serving as the post processing apparatus. The communication section 102 communicates with the other apparatuses currently coupled thereto. The operation display section 103 notifies the control section 101 of operation input signals generated corresponding to inputting operations performed by the user and displays current statuses of the image forming apparatus 100. The storage section 104 stores control programs and various kinds of setting data therein, and is used as a working area for executing the control programs. The paper sheet feeding section 105 feeds a paper sheet accommodated therein. The conveyance section 110 conveys the paper sheet, fed from the paper sheet feeding tray, or a paper sheet to be employed for an image forming operation, at a predetermined velocity. The document reading section 120 generates image data by scanning a document. The image data storage section 130 stores image data and various kinds of data, both to be used on an occasion of performing an image forming operation. The image processing section 140 implements various kinds of image processing necessary for the image forming operation. Based on image forming commands and processed image data acquired by applying the image processing to the image data, the image forming section 150 implements a printing operation (hereinafter, referred to as an "image forming operation").

Further, herein, by receiving signals outputted by sensors disposed at various kinds of positions within the conveyance sections of the image forming apparatus 100, the abnormality detecting section 115 detects a primary abnormal state in which an operation for conveying a paper sheet cannot be continued due to the fact that the paper sheet has jammed at any one of the conveyance sections provided in the apparatus concerned, or a secondary abnormal state in which a certain negative influence would be possibly given to the image quality, such as an inclination of an image formed on the paper sheet, a dropout of an image to be formed on the paper sheet, or the like, due to an abnormality of the paper sheet conveyance operation, such as an inclined conveyance, a leaning conveyance to one side, a duplicate conveyance, etc. In other words, hereinafter, the paper jam occurrence status is defined as the primary abnormal state, while, any one of the paper-sheet inclination occurrence status, the paper-sheet leaning occurrence status and the paper-sheet duplicate conveyance status, at the time of performing the conveyance operation, is defined as the secondary abnormal state.

Successively, the abnormality detecting section 115 notifies the control section 101 of the above-detected result. In this connection, a sensor **115*s*1, shown in FIG. 2, is employed for detecting the secondary abnormal state, such as a leaning or inclination of a paper sheet residing in the vicinity of the transferring point at which a toner image is transferred from an image bearing member to the paper sheet concerned, a duplicate conveyance operation erroneously performed by the paper sheet feeding section, a delay of timing for feeding a paper sheet residing at a pair of paper sheet feeding rollers or a resist roller, etc. Other than the sensor 115*s*1**, the sensors (not shown in the drawings) are disposed at various places within the paper sheet conveyance sections.

Further, the paper sheet on which an image is already formed by the image forming apparatus 100 is conveyed out to the intermediate apparatus 200, serving as a subsequent stage of the image forming apparatus 100. Namely, the intermediate apparatus 200 is cascaded to the image forming apparatus 100 as the subsequent stage thereof. The intermediate apparatus 200 is constituted by a control section 201, a communication section 202, a storage section 204, a conveyance path selecting section 205, a conveyance section 210, an abnormality detecting section 215 and a paper sheet reversing section 220.

The control section 201 controls operations to be performed by the various kinds of sections disposed within the intermediate apparatus 200. The communication section 202 communicates with the image forming apparatus 100. The storage section 204 stores control programs and various kinds of setting data therein, and is used as a working area for executing the control programs. The conveyance path selecting section 205 selects a conveyance path to be currently employed for conveying the paper sheet. The conveyance section 210 conveys the paper sheet at a predetermined velocity. The abnormality detecting section 215 detects a paper jam by receiving signals outputted by sensors disposed at various kinds of positions within the conveyance sections of the intermediate apparatus 200. The paper sheet reversing section 220 conveys the paper sheet so as to reverse the paper sheet currently conveyed.

In this connection, the paper sheets conveyed through the intermediate apparatus 200 is conveyed out towards the paper sheet processing apparatus 300 serving as a subsequent stage thereof. Concretely speaking, the post processing apparatus 300 is coupled to the image forming apparatus 100 as a subsequent stage of the image forming apparatus 100. Further, the post processing apparatus 300 is constituted by a control section 301, a communication section 302, a storage section 304, an conveyance path selecting section 305, an ejection path selecting section 306, a conveyance section 310, an abnormality detecting section 315, a paper sheet inserting section 320, a punching section 330, a folding section 340, a binding section 350, a cutting section 360, a sub-tray ejecting section 390S and a main-tray ejecting section 390M.

In this connection, the control section 301 controls various kinds of sections provided in the post processing apparatus 300. The communication section 302 communicates with the image forming apparatus 100. The storage section 304 stores control programs and various kinds of setting data therein, and is used as a working area for executing the control programs. The conveyance path selecting section 305 selects an insertion path through which the insertion paper sheet is to be inserted. The ejection path selecting section 306 selects an ejection path through which a bunch of post-processed paper sheets is to be ejected. The conveyance section 310 conveys the paper sheet at a predetermined velocity. The abnormality detecting section 315 detects a paper jam by receiving signals outputted by sensors disposed at various kinds of positions within the conveyance sections of the post processing apparatus 300. The paper sheet inserting section 320 inserts an insertion paper sheet, accommodated in a PI (Paper Inserter) section, into the paper sheet conveyance path.

The punching section 330 punches a binding hole onto the paper sheet. The folding section 340 folds the paper sheet in half or three. The binding section 350 applies a binding processing, such as a saddle-stitch processing, a side-staple processing, etc., to paper sheets so as to create a booklet. The cutting section 360 cuts the end portion of the booklet. The sub-tray ejecting section 390S ejects the paper sheet or the booklet onto the sub-tray shown in FIG. 2, serving as an ejecting destination thereof. The main-tray ejecting section 390M ejects the paper sheet or the booklet onto the main-tray shown in FIG. 2, serving as an ejecting destination thereof. Incidentally, each of the paper sheet processing functions or each of the structural constituents, provided in the post processing apparatus 300, is indicated as merely an example. The scope of the present invention is not limited to the example indicated in the above.

FIG. 3 shows a schematic diagram indicating an exemplified process that the paper sheets are conveyed within the image forming system. Herein, paper sheets p1~p10 are fed from the paper sheet feeding section 105. Further, paper sheets p1~p3 are already ejected onto the main-tray ejecting section 390M, while paper sheets p4~p10 remain at various positions within the image forming system.

<Operations>

Referring to the flowcharts and the sequence charts shown in FIG. 4 and the drawings followed thereto, an image forming system, a post processing apparatus and a method for controlling an image forming operation in accordance with the present invention, will be detailed in the following, according to the operating procedures thereof.

Hereinafter, the controlling operations for effectively and appropriately conducting the conveyance operations in the pre-purge processing will be detailed as the main subject in the following. In this connection, the pre-purge processing is defined as such a processing that makes it possible to continue the operation for conveying paper sheets currently remaining within the apparatus concerned though the operation for conveying the jam-causing paper sheet is disabled, instead of halting all operations for conveying the paper sheets currently residing within the apparatus as a whole.

Figure 4:
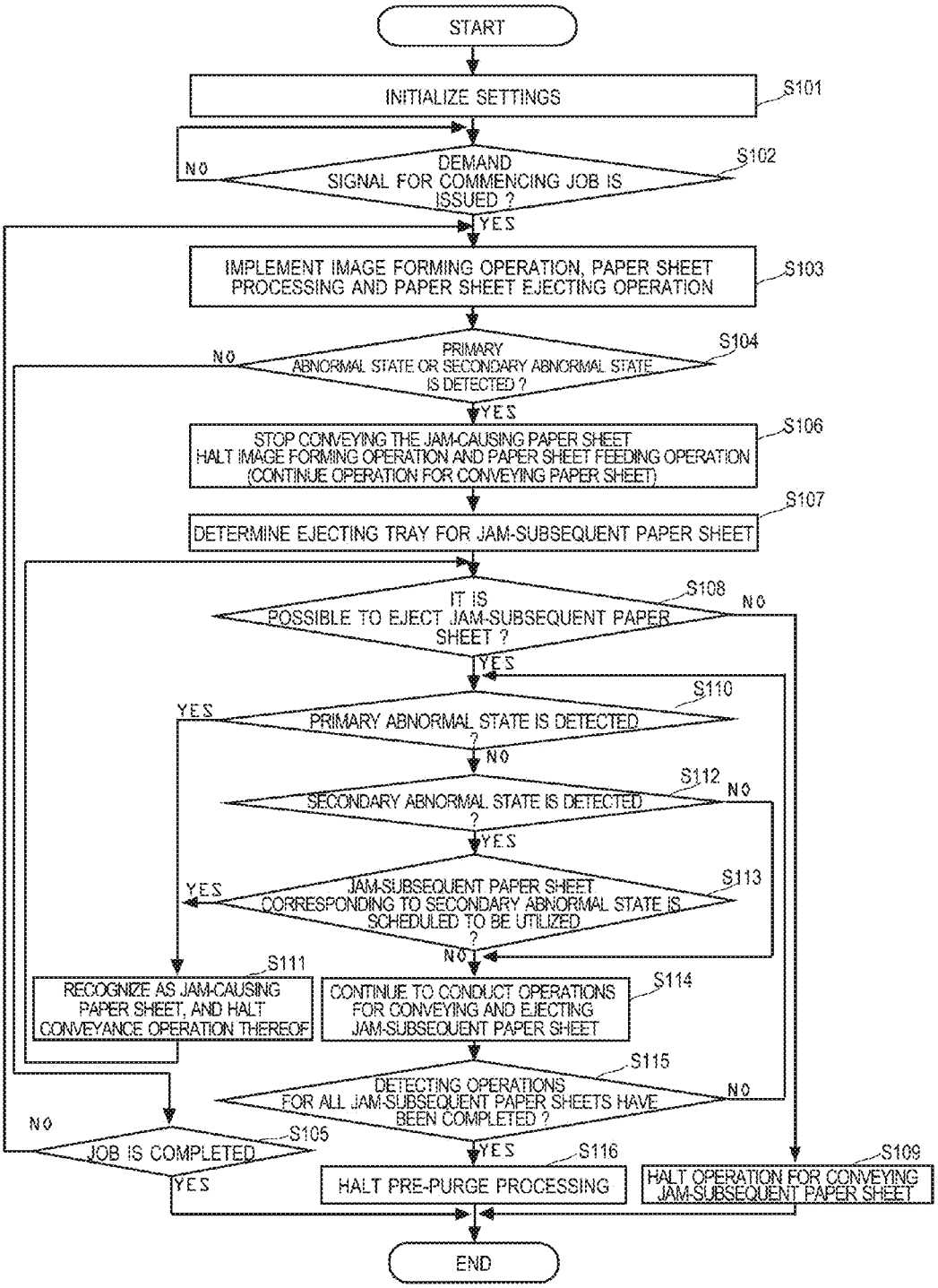
FIG. 4 is a flowchart indicating a flow of various kinds of operations to be conducted in an image forming system in accordance with an embodiment of the present invention.

Initially, at the time when commencing the operations of the image forming system including the image forming apparatus 100, the control section 101 initializes settings established in each of the sections provided in the system (Step S101, shown in FIG. 4). The initializing operations above-mentioned are implemented according to the predetermined procedures so that each of various sections is made to be set at an initial position thereof, each of the voltage values and the detected values is established at a predetermined value.

The control section 101 always monitors an issuance of a demand signal for commencing an image forming operation, which is to be issued from the operation display section 103 or an external computer (Step S102, shown in FIG. 4). Receiving the demand signal for commencing an image forming operation (Step S102; YES, shown in FIG. 4), the control section 101 controls the paper sheet feeding section 105, conveyance section 110, the image data storage section 130, the image processing section 140 and the image forming section 150, so as to form an image, based on image data designated, onto a paper sheet (Step S103, shown in FIG. 4).

Further, in a case when the demand signal also designates a paper sheet processing other than the image forming operation, the control section 101 controls the paper sheet reversing section 220 to perform the paper sheet reversing operation through the control section 201, as needed. In addition, the control section 101 controls the punching section 330, the folding section 340, the binding section 350 and/or the cutting section 360 to perform designated paper-sheet processing through the control section 301, as needed.

Still further, the control section 101 controls the ejecting tray designated by the job in regard to the paper sheet to which the image forming operation and the paper sheet processing has been completed. For instance, the control section 101 controls the main-tray ejecting section 390M to eject the paper sheet onto a main-tray 390*m* through the control section 301 as indicated in the schematic diagram shown in FIG. 3.

Now, it is assumed that any one of the abnormality detecting sections 115 through 315 detects the primary abnormal state or the secondary abnormal state, aforementioned, during the time when implementing the paper sheet conveyance operations associating with the image forming operation and the paper sheet processing (Step S104; YES, shown in FIG. 4). On the other hand, in a case when all of the abnormality detecting sections 115 through 315 detect neither the primary abnormal state nor the secondary abnormal state, aforementioned, (Step S104; NO, shown in FIG. 4), the control section 101 determines whether or not the concerned job has been completed in Step S105. When determining that the job has been completed (Step S105; YES, shown in FIG. 4), the control section 101 finalizes the pre-purge processing (END), while, when determining that the job has not been completed (Step S105; NO, shown in FIG. 4), the control section 101 returns to Step S103.

In this connection, hereinafter, in such a state that any one of the abnormality detecting sections 115 through 315 detects the primary abnormal state or the secondary abnormal state in midcourse of conveying paper sheets, a paper sheet that causes the abnormality above-detected is defined as a "jam-causing paper sheet". While, in such a state that the any one of the abnormality detecting sections 115 through 315 detects the primary abnormal state or the secondary abnormal state in midcourse of conveying paper sheets, another paper sheet that currently remains at a position upstream from the jam-causing paper sheet (including such a paper sheet that is just fed from the paper sheet feeding section 105 even if only slightly) is defined as a "jam-subsequent paper sheet".

Successively from Step S104; YES, the control section 101 in conjunction with the control section 201 and/or the control section 301 controls the conveyance sections 110 through 310 so as to stop conveying the jam-causing paper sheet at the abnormality detected position (Step S106, shown in FIG. 4). Further, the control section 101 controls not only the paper sheet feeding section 105 to disable a next paper sheet feeding operation, but also the image forming section 150 to halt the image forming operation currently performed. In this connection, the control section 101 controls the conveyance sections 110 through 310 so as to continue the operation for conveying the paper sheet, the feeding operation of which has been already commenced.

Figure 5:
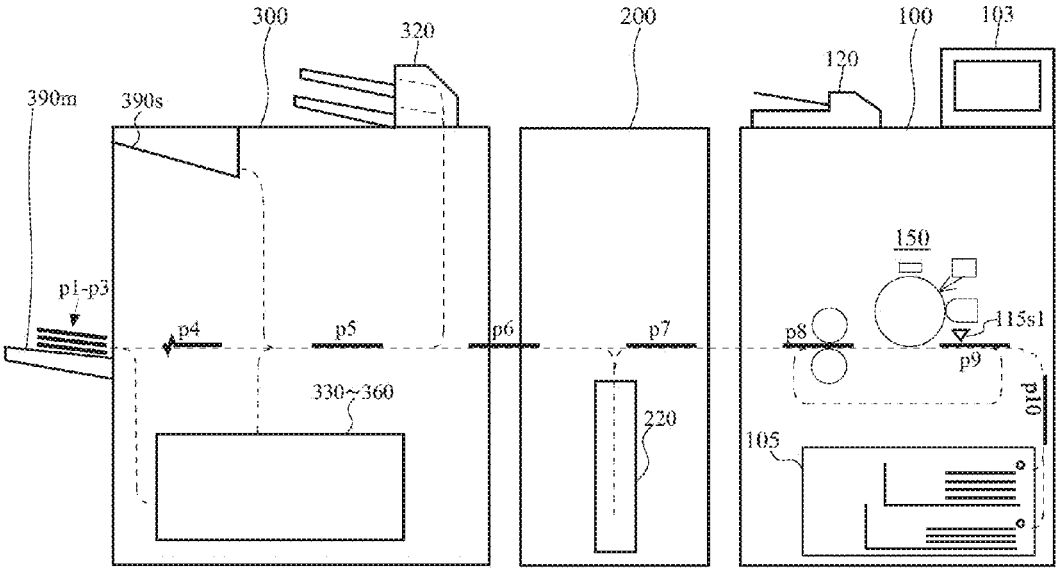
FIG. 5 is an explanatory schematic diagram showing a structural configuration of an image forming system in accordance with an embodiment of the present invention and indicating an operating status of paper sheets being conveyed therethrough.

The schematic diagram shown in FIG. 5 shows such a case that an abnormality of the paper sheet p4 has been detected at a position just before the main tray 390*m* in midcourse of the conveying operation thereof, and the paper sheet p4 is determined as the jam-causing paper sheet, the conveying operation of which is halted. In the case shown in FIG. 5, the paper sheets p5 through p10 correspond to the jam-subsequent paper sheets. With respect to the jam-subsequent paper sheets determined as not to halt the conveying operation thereof, the control section 101 conducts controlling operations so as to continue the conveying operation thereof. In addition, the control section 101 conducts controlling operations so as to halt the image forming operation currently performed and to disable the operation for newly feeding a next paper sheet.

Still successively, the control section 101 determines a specific ejecting tray (separate ejecting tray), other than the ejecting tray (designated ejecting tray) designated in regard to the job concerned, as an ejecting destination tray onto which the jam-subsequent paper sheets are to be ejected (Step S107, shown in FIG. 4). In this connection, it is assumed herein that the ejecting tray (designated ejecting tray) designated in regard to the job concerned is the main tray 390*m* as shown in FIG. 5. In this case, the sub-tray 390*s* corresponds to the specific ejecting tray (separate ejecting tray) other than the designated ejecting tray.

Still successively, the control section 101 in conjunction with the control section 201 and/or the control section 301 determines whether it is possible or impossible to eject the jam-subsequent paper sheets onto the separate ejecting tray (Step S108, shown in FIG. 4). In this connection, it is possible to determine whether it is possible or impossible to eject the jam-subsequent paper sheets onto the separate ejecting tray, from the relationship between the conveyance path branching position at which the designated ejecting tray and the separate ejecting tray are branched from each other, and the current position of the jam-subsequent paper sheet at the time when the abnormality has been detected.

Still successively, when determining that it is impossible to eject the jam-subsequent paper sheet onto the separate ejecting tray (Step S108; NO, shown in FIG. 4), the control section 101 in conjunction with the control section 201 and/or the control section 301 controls the conveyance sections 110 through 310 so as to halt the operation for conveying the jam-subsequent paper sheet at the existing position thereof (Step S109, shown in FIG. 4). In this connection, in a case when the jam-subsequent paper sheet resides near the jam-causing paper sheet and downstream from the branching point towards the separate ejecting tray, impossibility of ejecting the jam-causing paper sheet onto the separate ejecting tray may occur. For this reason, it is desirable that the determining operation in Step S108 is performed in order of the jam-subsequent paper sheet that resides near the jam-causing paper sheet, first. Further, after the pr-purge processing has been completed, the user may remove both the jam-causing paper sheet and the jam-subsequent paper sheet that could not be ejected onto the separate ejecting tray from the image forming system concerned.

Still successively, when determining that it is possible to eject the jam-subsequent paper sheet onto the separate ejecting tray (Step S108; YES, shown in FIG. 4), the control section 101 in conjunction with the control section 201 and/or the control section 301 controls the conveyance sections 110 through 310 so as to continue the operation for conveying the jam-subsequent paper sheet and to eject it onto the separate ejecting tray, without halting the conveyance operation thereof.

Still successively, even during the operations for conveying and ejecting the jam-subsequent paper sheets, the abnormality detecting sections 115 through 315 perform operations for detecting the primary abnormal state or the secondary abnormal state (Step S110 and Step S112, shown in FIG. 4). In this connection, in the abnormality detecting operation above-mentioned, preceding to the operation for detecting the secondary abnormal state, the operation for detecting the primary abnormal state is performed (Step S110, shown in FIG. 4), and as a result, when the primary abnormal state is not detected (Step S110; NO, shown in FIG. 4), the operation for detecting the secondary abnormal state is to be performed (Step S112, shown in FIG. 4).

In this connection, the abnormality detecting section 115 notifies the control section 101 of the result detected thereby. Further, the abnormality detecting section 215 notifies the control section 101 of the result detected thereby, through the control section 201. Still further, the abnormality detecting section 315 notifies the control section 101 of the result detected thereby, through the control section 301. Then, all of the abnormality detected results are consolidated into the control section 101.

Still successively, since the jam-subsequent paper sheet, detected as in the primary abnormal state (Step S110; YES, shown in FIG. 4), currently enters into such a state that the conveyance operation cannot be continued due to occurrence of the paper jam in midcourse of conveying the jam-subsequent paper sheet concerned, the control section 101 newly recognizes the concerned paper sheet as the jam-causing paper sheet, and controls the conveyance sections 110 through 310 so as to halt the conveyance operation thereof at the jam detected position (Step S111, shown in FIG. 4). Then, with respect to the next paper sheet followed by the preceding paper sheet, which has been newly recognized as the jam-causing paper sheet as a result of detecting the primary abnormal state in the above, the control section 101 returns to Step S108 so as to commence the processing of the next paper sheet newly established as the jam-subsequent paper sheet.

On the other hand, when determining that the primary abnormal state is not detected in the jam-subsequent paper sheet (Step S110; NO, shown in FIG. 4) and when determining that the secondary abnormal state is detected in the jam-subsequent paper sheet (Step S112; YES, shown in FIG. 4), various kinds of image failures, such as a leaning of image to one side, an inclination of image, a dropout of image, etc., may be possibly generated in the image formed on the jam-subsequent paper sheet, though it is possible to convey the paper sheet concerned. For this reason, the control section 101 confirms whether or not the jam-subsequent paper sheet corresponding to the secondary abnormal state is scheduled to be utilized (Step S113, shown in FIG. 4). In this connection, it is desirable that the determination in regard to whether or not the jam-subsequent paper sheet corresponding to the secondary abnormal state is scheduled to be utilized as an image forming output product, is established in advance by inputting operations performed on the operation display section 103 or by the external computer, etc. Further, in a case where the determination is not established as "SCHEDULED TO BE UTILIZED", the determination may be regarded as "NOT SCHEDULED TO BE UTILIZED".

Still successively, when determining that the jam-subsequent paper sheet corresponds to the secondary abnormal state (Step S112; YES, shown in FIG. 4) and when determining that the jam-subsequent paper sheet concerned is scheduled to be utilized without being wasted (Step S113; YES, shown in FIG. 4), the image quality thereof may be possibly suffered from a certain adverse influence since the jam-subsequent paper sheet corresponds to the secondary abnormal state. In other words, it is undesirable to utilize such the jam-subsequent paper sheet in a normal way. For this reason, the control section newly establishes the paper sheet, corresponding to the secondary abnormal state and scheduled to be utilize, as the jam-causing paper sheet, and then, controls the conveyance sections 110 through 310 so as to halt the conveyance operation thereof at the abnormality detected position (Step S111, shown in FIG. 4). Then, with respect to the next paper sheet followed by the preceding paper sheet, which has been newly recognized as the jam-causing paper sheet as a result of detecting the secondary abnormal state in the above, the control section 101 returns to Step S108 so as to commence the processing of the next paper sheet newly established as the jam-subsequent paper sheet.

Still successively, when determining that neither the primary abnormal state nor the secondary abnormal state is detected in respect to the jam-subsequent paper sheet (Step S110; NO, Step S112; NO, shown in FIG. 4), or when determining that the primary abnormal state is not detected but the secondary abnormal state is detected in respect to the jam-subsequent paper sheet and the jam-subsequent paper sheet concerned is not scheduled to be utilized (Step S110; NO, Step S112; YES, Step S113; NO, shown in FIG. 4), the control section 101 continues to conduct the operations for conveying and ejecting the jam-subsequent paper sheet concerned as the pre-purge processing (Step S114, shown in FIG. 4).

Still successively, with respect to all of the jam-subsequent paper sheets currently remaining at positions within the image forming system, the control section 101 implements the operations for detecting the primary abnormal state or the secondary abnormal state and the operations for controlling the conveyance operation (Step S108 through Step S114, shown in FIG. 4) for every one of the jam-subsequent paper sheets (Step S115, shown in FIG. 4).

Yet successively, as described in the foregoing, the control section 101 in conjunction with the control section 201 and the control section 301 halts the operations for conveying the jam-causing paper sheet, the jam-subsequent paper sheet that is newly recognized as the jam-causing paper sheet in midcourse of the conveyance operation of the pre-purge processing, and the other jam-subsequent paper sheet that cannot be ejected onto the separate ejecting tray. Then, the control section 101 in conjunction with the control section 201 and the control section 301 continues the operation for conveying still the other jam-subsequent paper sheet that can be ejected onto the separate ejecting tray, so as to eject it thereon. At this time, the control section 101 controls each of the sections so as to halt the operations for implementing the pre-purge processing (Step S116, shown in FIG. 4).

The schematic diagram shown in FIG. 5 shows such a case that, after the paper sheets p1 through p3 have been ejected onto the main tray 390*m*, the primary abnormal state of the paper sheet p4 has been detected at a position just before the main tray 390*m* in midcourse of the conveying operation thereof, and the paper sheet p4 is determined as the jam-causing paper sheet, the conveying operation of which is halted. In the case shown in FIG. 5, since the paper sheets p5 through p10 correspond to the jam-subsequent paper sheets, the aforementioned pre-purge processing is applied to the paper sheets p5 through p10. In addition, the operation for feeding the next paper sheet is disabled.

Figure 6:
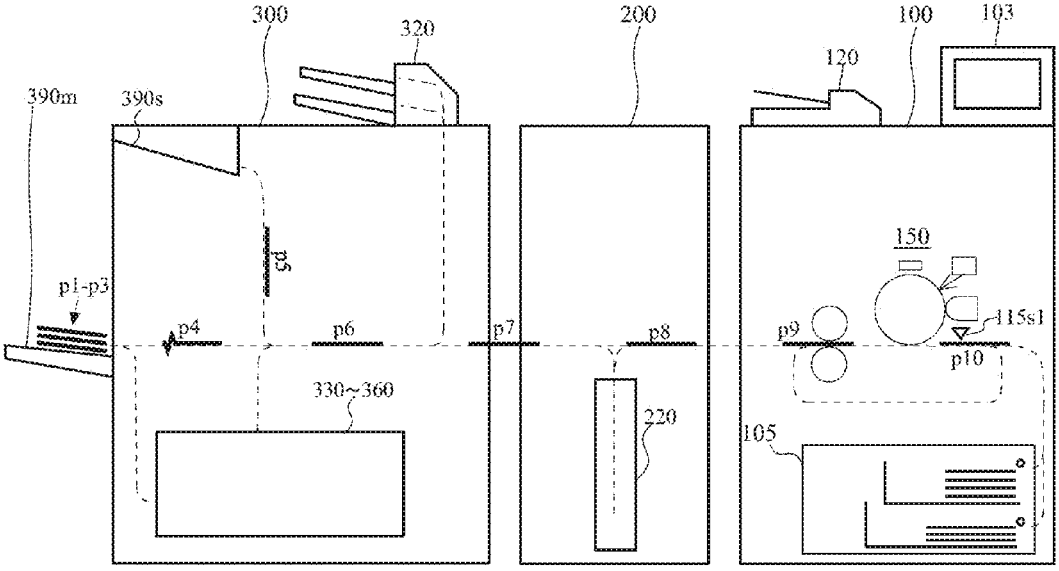
FIG. 6 is another explanatory schematic diagram showing a structural configuration of an image forming system in accordance with an embodiment of the present invention and indicating an operating status of paper sheets being conveyed therethrough.
Figure 7:
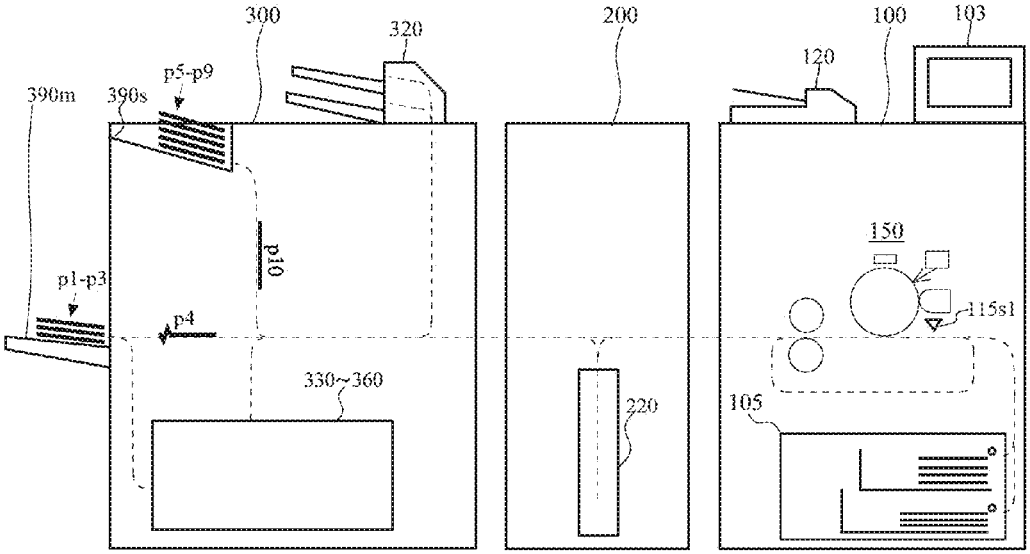
FIG. 7 is still another explanatory schematic diagram showing a structural configuration of an image forming system in accordance with an embodiment of the present invention and indicating an operating status of paper sheets being conveyed therethrough.
Figure 8:
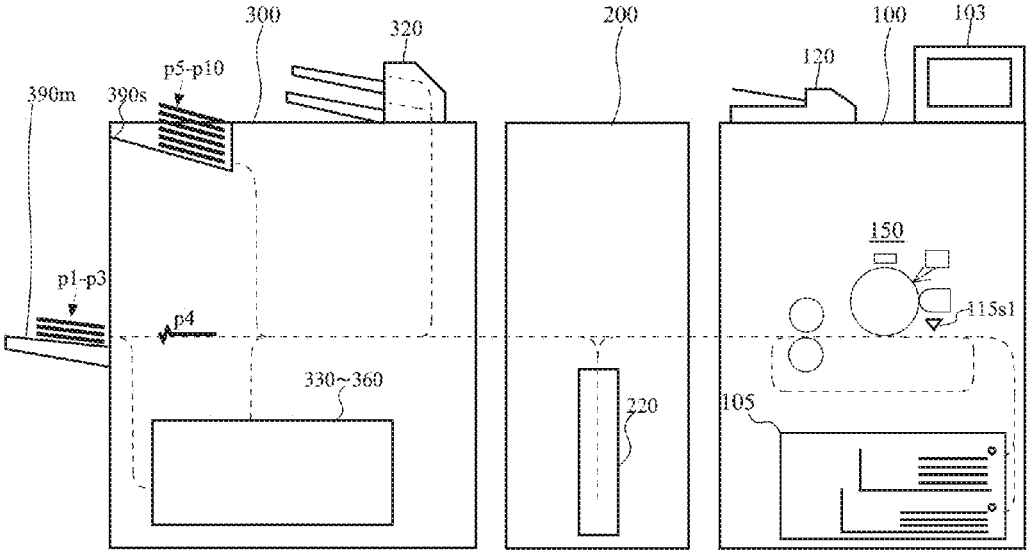
FIG. 8 is yet another explanatory schematic diagram showing a structural configuration of an image forming system in accordance with an embodiment of the present invention and indicating an operating status of paper sheets being conveyed therethrough.

In this connection, in a case where the sub-tray 390*s* is established as the separate ejecting tray, the paper sheet p5 serving as the jam-subsequent paper sheet is conveyed towards the sub-tray 390*s*, as shown in FIG. 6. Then, as indicated in the schematic diagrams respectively shown in FIG. 7 and FIG. 8, the paper sheets p5 through p10, which currently remain at the positions within the image forming system as the jam-subsequent paper sheets, are conveyed towards the sub-tray 390*s* and ejected thereon.

Figure 9:
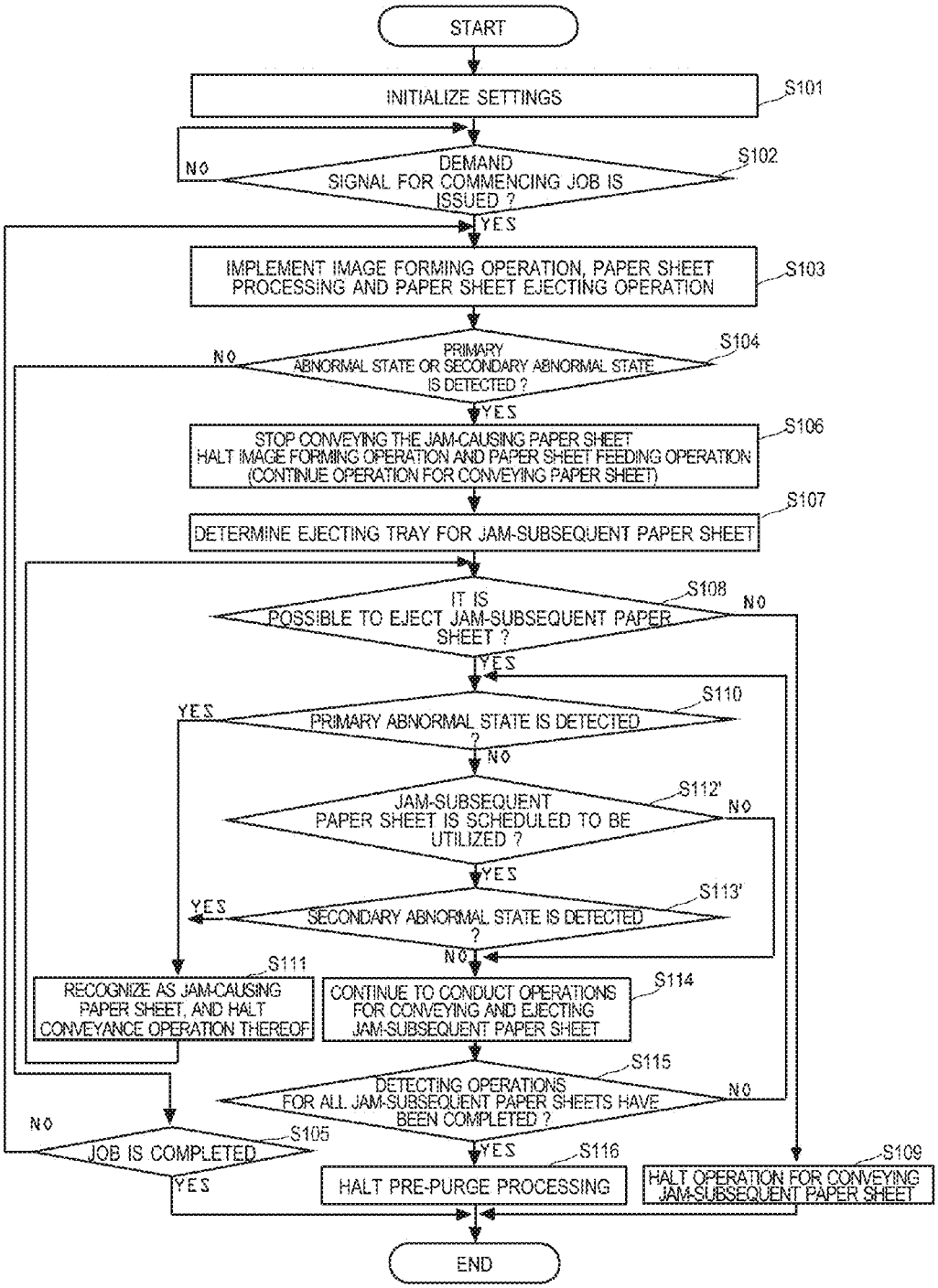
FIG. 9 is a flowchart indicating a flow of various kinds of operations to be conducted in an image forming system in accordance with an embodiment of the present invention.

FIG. 9 is a flowchart indicating a flow of operating steps as a modified example of the controlling operations in the pre-purge processing aforementioned. In this connection, the step same as that in the flowchart shown in FIG. 4 is attached with the same number, and duplicated explanations therefore will be omitted.

In the operations to be performed in the flowchart shown in FIG. 9, with respect to the jam-subsequent paper sheet that is scheduled to be utilized without being wasted (Step S112'; YES, shown in FIG. 9), the control section 101 determines not only whether or not the primary abnormal state is detected (Step S110, shown in FIG. 9), but also whether or not the secondary abnormal state is detected (Step S113', shown in FIG. 9). In this case, actually, the processing same as those in the flowchart shown in FIG. 4 are performed, though the processing order in the flowchart shown in FIG. 9 is different from that in the flowchart shown in FIG. 4.

On the other hand, with respect to the jam-subsequent paper sheet that is not scheduled to be utilized (Step S112'; NO, shown in FIG. 9), although the control section 101 determines whether or not the primary abnormal state is detected (Step S110, shown in FIG. 9), the control section 101 skips Step S113' for determining whether or not the secondary abnormal state is detected, and continues the operations for conveying and ejecting the jam-subsequent paper sheet as the pre-purge processing (Step S114, shown in FIG. 9). According to the above-mentioned, compared to the processing indicated in the flowchart shown in FIG. 4, since the operation for detecting the secondary abnormal state is skipped, it becomes possible to reduce the processing burden to be incurred to the control section 101, and accordingly, it becomes possible to implement the pre-purge processing effectively.

Figure 10:
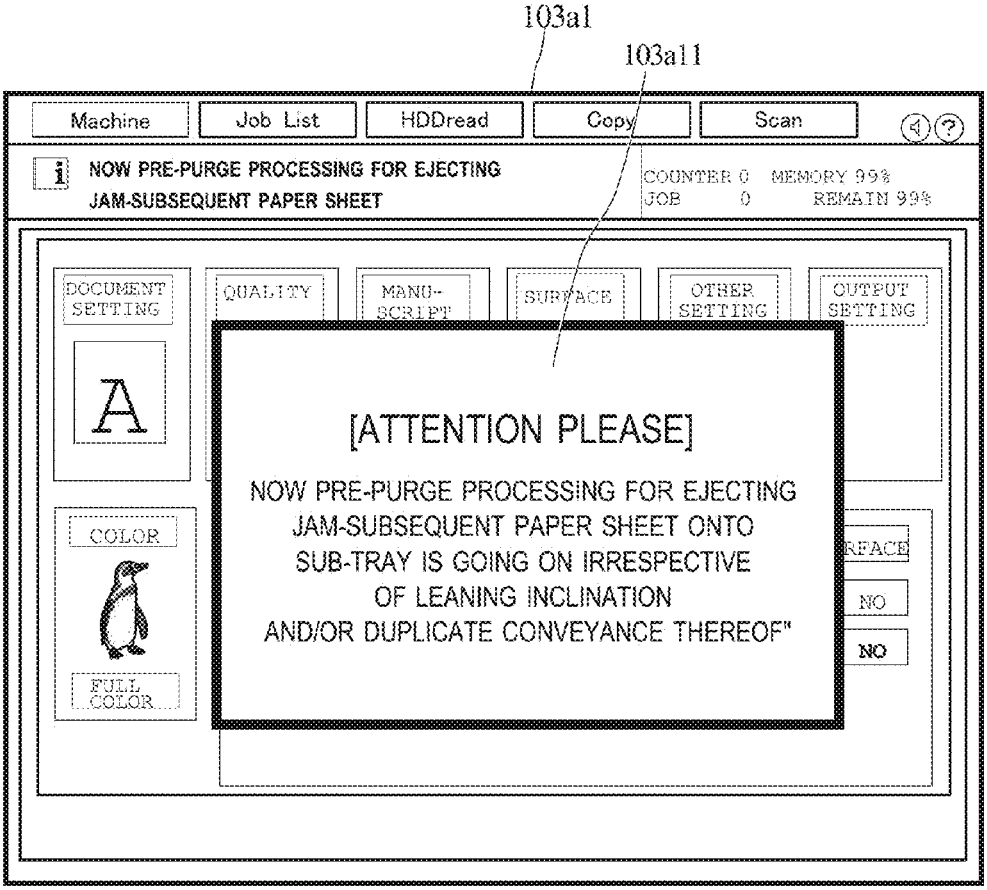
FIG. 10 is an explanatory schematic diagram showing a display screen overlapped with a pop-up display screen to be displayed on a display section of an image forming system in accordance with an embodiment of the present invention.

FIG. 10 is a schematic diagram showing an example of a display screen 103*a*1 to be displayed by the operation display section 103. In the controlling operations above-mentioned, in a case where it has been established in advance that the jam-subsequent paper sheet, which has been determined as in the secondary abnormal state possibly causing a certain adverse influence onto an image formed thereon, is not scheduled to be utilized as an image forming output product, or, in a case when it is not established whether or not the concerned jam-subsequent paper sheet is scheduled to be utilized and the jam-subsequent paper sheet determined as in the secondary abnormal state is to be ejected (Step S112; Yes, Step S113; NO, Step S114, shown in FIG. 4), or in a case where the jam-subsequent paper sheet is to be ejected without detecting the secondary abnormal state (Step S112'; NO, Step S114, shown in FIG. 9), the control section 101 controls the operation display section 103 so as to display the display screen 103*a*1 thereon.

On the display screen 103*a*1, a pop-up display screen 103*a*11 is displayed in order to indicate the fact that the pre-purge processing for ejecting a jam-subsequent paper sheet onto the sub-tray is currently implemented, irrespective of occurrence of leaning, inclination and/or duplicate conveyance of the paper sheets in the secondary abnormal state. For instance, as shown in FIG. 10, the message, indicating "[ATTENTION PLEASE] NOW, PRE-PURGE PROCESSING FOR EJECTING JAM-SUBSEQUENT PAPER SHEET ONTO SUB-TRAY IS GOING ON, IRRESPECTIVE OF LEANING, INCLINATION AND/OR DUPLICATE CONVEYANCE THEREOF", is displayed within the pop-up display screen 103*a*11. According to the above-mentioned feature, it becomes possible to prevent the user from erroneously using the jam-subsequent paper sheet, determined as in the secondary abnormal state, as the image forming output product.

<Effects Acquired from Embodiment>

As described in the foregoing, the primary abnormal state in which the conveyance section is incapable of continuing the operation for conveying said paper sheet, and the secondary abnormal state in which an adverse influence is possibly incurred to the image formed on the paper sheet though the conveyance section is capable of continuing the operation for conveying the paper sheet, are defined. Then, in the state that the primary abnormal state or the secondary abnormal state is detected in midcourse of the operation for conveying the paper sheet, when implementing a pre-purge processing for conveying the jam-subsequent paper sheet so as to eject the jam-subsequent paper sheet onto the ejecting tray, the control section 101 conducts controlling operations so as to continue the operation for conveying the paper sheet without halting the operation for conveying the paper sheet, even if the secondary abnormal state in respect to the jam-subsequent paper sheet is detected in midcourse of performing the pre-purge processing thereof. By conducting the controlling operations in a manner as above-mentioned, it becomes possible to effectively eject the jam-subsequent paper sheet in midcourse of performing the pre-purge processing thereof.

Further, in a case when the primary abnormal state in respect to the jam-subsequent paper sheet is detected by the abnormality detecting section in midcourse of performing the pre-purge processing thereof, the control section conducts controlling operations so as to halt the operation for conveying the paper sheet without continuing the operation for conveying the paper sheet. By conducting the controlling operations in a manner as above-mentioned, it becomes possible not only to effectively eject the jam-subsequent paper sheet in midcourse of performing the pre-purge processing thereof, but also to halt the operation for conveying the paper sheet as needed. As a result, it becomes possible to implement stable controlling operations.

Still further, in a case where the jam-subsequent paper sheet ejected in the pre-purge processing is to be utilized as an output product, when the secondary abnormal state in respect to the jam-subsequent paper sheet is detected in midcourse of performing the pre-purge processing thereof, the control section conducts controlling operations so as to halt the operation for conveying the paper sheet without continuing the operation for conveying the paper sheet. By conducting the controlling operations in a manner as above-mentioned, it becomes possible not only to effectively eject the jam-subsequent paper sheet in midcourse of performing the pre-purge processing thereof, but also to halt the operation for conveying the paper sheet as needed. As a result, it becomes possible to implement stable controlling operations.

Still further, the control section has a function for accepting a setting established by determining whether or not the jam-subsequent paper sheet ejected in the pre-purge processing is to be utilized. By conducting the controlling operations in a manner as above-mentioned, it becomes possible not only to effectively eject the jam-subsequent paper sheet in midcourse of performing the pre-purge processing thereof, but also to halt the operation for conveying the paper sheet as needed, in response to the request of the user. As a result, it becomes possible to implement stable controlling operations.

Still further, in a case where the operation for conveying the paper sheet is to be continued due to a fact that the secondary abnormal state in respect to the jam-subsequent paper sheet is detected in midcourse of performing the pre-purge processing thereof, the control section 101 controls the display section 103 to display a message indicating that the operation for conveying the paper sheet is continued in the secondary abnormal state currently detected, thereon. By conducting the controlling operations in a manner as above-mentioned, it becomes possible not only to effectively eject the jam-subsequent paper sheet in midcourse of performing the pre-purge processing thereof, but also to notify the user of the status of the jam-subsequent paper sheet currently ejected.

Yet further, the ejecting section is provided with a plurality of ejecting trays being independent from each other. The control section conducts the controlling operations so that the paper sheet, in which neither the primary abnormal state nor the secondary abnormal state is detected, is ejected onto one of the plurality of ejecting trays, while the jam-subsequent paper sheet, which is to be conveyed in the pre-purge processing, is ejected onto another one of the plurality of ejecting trays. By conducting the controlling operations in a manner as above-mentioned, it becomes possible not only to effectively eject the jam-subsequent paper sheet in midcourse of performing the pre-purge processing thereof, but also to handle the normal paper sheet and the jam-subsequent paper sheet ejected by the pre-purge processing, separately and independently.

<Other Embodiments>

Referring to the drawings, an embodiment in accordance with the present invention has been described in the foregoing. It is needless to say that the scope of the present invention, in regard to the concrete configuration, the connecting mode, etc., is not limited to the embodiment aforementioned. Various kinds of modifications and additions, made by a skilled person without departing from the spirit and scope of the invention, shall be included in the scope of the present invention.

In the embodiment described in the foregoing, such a case that the control section 101 provided in the image forming apparatus 100 serves as the central section performing the controlling operations at the time when the pre-purge processing is implemented, has been exemplified as an embodiment of the present invention. However, the scope of the present invention is not limited to the above-mentioned embodiment. For instance, any one of the control section 201 and the control section 301 respectively provided in the intermediate apparatus 200 and the post processing apparatus 300, other than the image forming apparatus 100, may instruct the other control sections to implement the pre-purge processing same as the above-mentioned. Further, it is also applicable that the system is so constituted that each of the control sections 101 through 301 independently implements the pre-purge processing, and then, notifies the other control sections of the results of the controlling operations implemented in its own apparatus.

Further, it is possible to equip the operation display section not only in the image forming apparatus 100, but also in any one of the intermediate apparatus 200 and the post processing apparatus 300. Further, it is also possible to employ an operating section and/or a display section, which is provided in an external computer coupled to the image forming system through a network.

Still further, although a concrete example of the combination of the main tray 390*m* and the sub-tray 390*s* is indicated in the schematic diagrams shown in FIGS. 1 and 2, the positions and the number thereof are not limited to those indicated in the concrete example. Further, in a case when a plurality of vacant trays exists, it is desirable that such a tray, on which the jam-subsequent paper sheets can be ejected as many as possible, is selected as the separate ejecting tray from the plurality of vacant trays.

Still further, in a case where the jam-subsequent paper sheet stops in midcourse of the conveying operation thereof, due to a detection of the primary abnormal state, and is determined as the jam-causing paper sheet, it is applicable that a plurality of trays are established as separate ejecting trays to control the ejecting operation so as to eject the jam-subsequent paper sheets as many as possible.

Yet further, the secondary abnormal state is defined as such a state that a certain adverse influence is incurred to the image quality of the image formed on the paper sheet in midcourse of the conveying operation thereof, such as an inclination of the image, a dropout of the image, etc. For this reason, the secondary abnormal state is not limited to the leaning to one side, the inclination and the duplicate conveyance thereof, and may include other adverse states.

While the preferred embodiments of the present invention have been described using specific term, such description is for illustrative purpose only, and it is to be understood that changes and variations may be made without departing from the spirit and scope of the appended claims.

What is claimed is:

1. An image forming apparatus, comprising:

an image forming section that forms an image onto a paper sheet;

a conveyance section that conveys the paper sheet;

an ejecting section that ejects the paper sheet onto an ejecting tray;

an abnormality detecting section that detects a primary abnormal state in which the conveyance section is incapable of continuing an operation for conveying the paper sheet, and a secondary abnormal state in which the conveyance section is capable of continuing the operation for conveying the paper sheet and in which a certain abnormal conveyance condition has occurred which is considered to have potential to negatively influence the image formed on the paper sheet; and a controller that conducts controlling operations for conveying the paper sheet in accordance with an image forming operation performed by the image forming section, so as to eject the paper sheet onto the ejecting tray of the ejecting section;

wherein, in a case in which the abnormality detecting section detects the primary abnormal state in midcourse of the operation for conveying the paper sheet, the controller recognizes the paper sheet which is detected as being in the primary abnormal state as a jam-causing paper sheet, and recognizes another paper sheet which remains upstream from the jam-causing paper sheet detected as being in the primary abnormal state as a jam-subsequent paper sheet, and in a case in which the abnormality detecting section detects the secondary abnormal state in midcourse of the operation for conveying the paper sheet, the controller recognizes the paper sheet which is detected as being in the secondary abnormal state as the jam-causing paper sheet, and the controller recognizes another paper sheet which remains upstream from the jam-causing paper sheet detected as being in the secondary abnormal state as the jam-subsequent paper sheet;

wherein the controller controls both the conveyance section and the ejecting section to implement a pre-purge processing for conveying the jam-subsequent paper sheet after a detection of the jam-causing paper sheet so as to eject the jam-subsequent paper sheet onto the ejecting tray when neither the primary abnormal state nor the secondary abnormal state with respect to the jam-subsequent paper sheet is detected by the abnormality detecting section in midcourse of performing the pre-purge processing thereof after the detection of the jam-causing paper sheet;

wherein, the control section the controller controls the conveyance section and the ejecting section to halt conveying the jam-subsequent paper sheet to the ejecting tray if the secondary abnormal state with respect to the jam-subsequent paper sheet is detected by the abnormality detecting section in midcourse of performing the pre-purge processing thereof after the detection of the jam-causing paper sheet and after the jam-subsequent paper sheet to be ejected in the pre-purge processing is set by the controller to be utilized; and wherein the controller controls the conveyance section not to halt conveying the jam-subsequent paper sheet to the ejecting tray if the secondary abnormal state with respect to the jam-subsequent paper sheet is detected by the abnormality detecting section in midcourse of performing the pre-purge processing thereof after the detection of the jam-causing paper sheet and after the jam-subsequent paper sheet to be ejected in the pre-purge processing is set by the controller not to be utilized.

2. The image forming apparatus of claim 1, wherein, in a case in which the primary abnormal state with respect to the jam-subsequent paper sheet is detected by the abnormality detecting section in midcourse of performing the pre-purge processing thereof, the controller controls the conveyance section and the ejecting section to halt the operation for conveying the jam-subsequent paper sheet without continuing the operation for conveying the jam-subsequent paper sheet.

3. The image forming apparatus of claim 1, wherein the controller accepts a setting established by determining whether or not the jam-subsequent paper sheet to be ejected in the pre-purge processing is to be utilized.

4. The image forming apparatus of claim 1, further comprising:

a display section that displays various kinds of display screens thereon, based on a controlling operation conducted by the controller;

wherein, in a case in which the operation for conveying the jam-subsequent paper sheet is to be continued due to a fact that the secondary abnormal state with respect to the jam-subsequent paper sheet is detected in midcourse of performing the pre-purge processing thereof, the controller controls the display section to display a message indicating that the operation for conveying the jam-subsequent paper sheet is continued in the secondary abnormal state currently detected.

5. The image forming apparatus of claim 1, wherein the ejecting section is provided with a plurality of ejecting trays being independent from each other; and wherein the controller controls the conveyance section and the ejecting section so that a paper sheet, with respect to which neither the primary abnormal state nor the secondary abnormal state is detected, is ejected onto one of the plurality of ejecting trays, and the jam-subsequent paper sheet, which is to be conveyed in the pre-purge processing, is ejected onto another one of the plurality of ejecting trays.

6. The image forming apparatus of claim 1, wherein the primary abnormal state is defined as a state in which the paper sheet has jammed, and the secondary abnormal state is defined as a state in which the paper sheet is leaning to one side or is inclined during the operation for conveying the paper sheet, or the paper sheet and another paper sheet are conveyed in duplicate, as the certain abnormal conveyance condition.

7. An image forming system, comprising:

an image forming section that forms an image onto a paper sheet;

a post processing section that applies a post processing to the paper sheet;

a conveyance section that conveys the paper sheet;

an ejecting section that ejects the paper sheet onto an ejecting tray;

an abnormality detecting section that detects a primary abnormal state in which the conveyance section is incapable of continuing an operation for conveying the paper sheet, and a secondary abnormal state in which the conveyance section is capable of continuing the operation for conveying the paper sheet and in which a certain abnormal conveyance condition has occurred which is considered to have potential to negatively influence the image formed on the paper sheet; and a controller that conducts controlling operations for conveying the paper sheet in accordance with an image forming operation performed by the image forming section, so as to eject the paper sheet onto the ejecting tray of the ejecting section;

wherein, in a case in which the abnormality detecting section detects the primary abnormal state in midcourse of the operation for conveying the paper sheet, the controller recognizes the paper sheet which is detected as being in the primary abnormal state as a jam-causing paper sheet, and recognizes another paper sheet which remains upstream from the jam-causing paper sheet detected as being in the primary abnormal state as a jam-subsequent paper sheet, and in a case in which the abnormality detecting section detects the secondary abnormal state in midcourse of the operation for conveying the paper sheet, the controller recognizes the paper sheet which is detected as being in the secondary abnormal state as the jam-causing paper sheet, and the controller recognizes another paper sheet which remains upstream from the jam-causing paper sheet detected as being in the secondary abnormal state as the jam-subsequent paper sheet;

wherein the controller controls both the conveyance section and the ejecting section to implement a pre-purge processing for conveying the jam-subsequent paper sheet after a detection of the jam-causing paper sheet so as to eject the jam-subsequent paper sheet onto the ejecting tray when neither the primary abnormal state nor the secondary abnormal state with respect to the jam-subsequent paper sheet is detected by the abnormality detecting section in midcourse of performing the pre-purge processing thereof after the detection of the jam-causing paper sheet;

wherein, the control section the controller controls the conveyance section and the ejecting section to halt conveying the jam-subsequent paper sheet to the ejecting tray if the secondary abnormal state with respect to the jam-subsequent paper sheet is detected by the abnormality detecting section in midcourse of performing the pre-purge processing thereof after the detection of the jam-causing paper sheet and after the jam-subsequent paper sheet to be ejected in the pre-purge processing is set by the controller to be utilized; and wherein the controller controls the conveyance section not to halt conveying the jam-subsequent paper sheet to the ejecting tray if the secondary abnormal state with respect to the jam-subsequent paper sheet is detected by the abnormality detecting section in midcourse of performing the pre-purge processing thereof after the detection of the jam-causing paper sheet and after the jam-subsequent paper sheet to be ejected in the pre-purge processing is set by the controller not to be utilized.

8. The image forming system of claim 7, wherein, in a case in which the primary abnormal state with respect to the jam-subsequent paper sheet is detected by the abnormality detecting section in midcourse of performing the pre-purge processing thereof, the controller controls the conveyance section and the ejecting section to halt the operation for conveying the jam-subsequent paper sheet without continuing the operation for conveying the jam-subsequent paper sheet.

9. The image forming system of claim 7, wherein the controller accepts a setting established by determining whether or not the jam-subsequent paper sheet to be ejected in the pre-purge processing is to be utilized.

10. The image forming system of claim 7, further comprising:

a display section that displays various kinds of display screens thereon, based on a controlling operation conducted by the controller;

wherein, in a case in which the operation for conveying the jam-subsequent paper sheet is to be continued due to a fact that the secondary abnormal state with respect to the jam-subsequent paper sheet is detected in midcourse of performing the pre-purge processing thereof, the controller controls the display section to display a message indicating that the operation for conveying the jam-subsequent paper sheet is continued in the secondary abnormal state currently detected.

11. The image forming system of claim 7, wherein the ejecting section is provided with a plurality of ejecting trays which are independent from each other; and wherein the controller controls the conveyance section and the ejecting section, so that a paper sheet, with respect to which neither the primary abnormal state nor the secondary abnormal state is detected, is ejected onto one of the plurality of ejecting trays, and the jam-subsequent paper sheet, which is to be conveyed in the pre-purge processing, is ejected onto another one of the plurality of ejecting trays.

12. The image forming system of claim 7, wherein the primary abnormal state is defined as a state in which the paper sheet has jammed, and the secondary abnormal state is defined as a state in which the paper sheet is leaning to one side or is inclined during the operation for conveying the paper sheet, or the paper sheet and another paper sheet are conveyed in duplicate, as the certain abnormal conveyance condition.

13. A method for controlling operations to be performed in an image forming apparatus or an image forming system, which includes: an image forming section that forms an image onto a paper sheet; a conveyance section that conveys the paper sheet; an ejecting section that ejects the paper sheet onto an ejecting tray; an abnormality detecting section that detects a primary abnormal state in which the conveyance section is incapable of continuing an operation for conveying the paper sheet, and a secondary abnormal state in which the conveyance section is capable of continuing the operation for conveying the paper sheet and in which a certain abnormal conveyance condition has occurred which is considered to have potential to negatively influence the image formed on the paper sheet; and a controller that conducts controlling operations for conveying the paper sheet in accordance with an image forming operation performed by the image forming section, so as to eject the paper sheet onto the ejecting tray of the ejecting section; wherein, in a case in which the abnormality detecting section detects the primary abnormal state in midcourse of the operation for conveying the paper sheet, the controller recognizes the paper sheet which is detected as being in the primary abnormal state as a jam-causing paper sheet, and recognizes another paper sheet which remains upstream from the jam-causing paper sheet detected as being in the primary abnormal state as a jam-subsequent paper sheet, and in a case in which the abnormality detecting section detects the secondary abnormal state in midcourse of the operation for conveying the paper sheet, the controller recognizes the paper sheet which is detected as being in the secondary abnormal state as the jam-causing paper sheet, and recognizes another paper sheet which remains upstream from the jam-causing paper sheet detected as being in the secondary abnormal state as the jam-subsequent paper sheet, the method comprising:

controlling both the conveyance section and the ejecting section to implement a pre-purge processing for conveying the jam-subsequent paper sheet after the detection of the jam-causing paper sheet so as to eject the jam-subsequent paper sheet onto the ejecting tray when neither the primary abnormal state nor the secondary abnormal state with respect to the jam-subsequent paper sheet is detected by the abnormality detecting section in midcourse of performing the pre-purge processing thereof after the detection of the jam-causing paper sheet;

controlling the conveyance section and the ejecting section to halt conveying the jam-subsequent paper sheet to the ejecting tray if the secondary abnormal state with respect to the jam-subsequent paper sheet is detected by the abnormality detecting section in midcourse of performing the pre-purge processing thereof after the detection of the jam-causing paper sheet and after the jam-subsequent paper sheet to be ejected in the pre-purge processing is set to be utilized; and controlling the conveyance section not to halt conveying the jam-subsequent paper sheet to the ejecting tray if the secondary abnormal state with respect to the jam-subsequent paper sheet is detected by the abnormality detecting section in midcourse of performing the pre-purge processing thereof after the detection of the jam-causing paper sheet and after the jam-subsequent paper sheet to be ejected in the pre-purge processing is set not to be utilized.

14. The method of claim 13, further comprising:

controlling the conveyance section and the ejecting section to halt the operation for conveying the jam-subsequent paper sheet without continuing the operation for conveying the jam-subsequent paper sheet, when the primary abnormal state with respect to the jam-subsequent paper sheet is detected by the abnormality detecting section in midcourse of performing the pre-purge processing thereof.

15. The method of claim 13, further comprising:

accepting a setting established by determining whether or not the jam-subsequent paper sheet to be ejected in the pre-purge processing is to be utilized.

16. The method of claim 13, wherein the image forming apparatus or the image forming system further includes a display section that displays various kinds of display screens thereon, based on a controlling operation conducted by the controller, the method further comprising:

controlling the display section to display a message indicating that the operation for conveying the jam-subsequent paper sheet is continued in the secondary abnormal state currently detected, in a case in which the operation for conveying the jam-subsequent paper sheet is to be continued due to a fact that the secondary abnormal state with respect to the jam-subsequent paper sheet is detected in midcourse of performing the pre-purge processing thereof.

17. The method of claim 13, wherein the ejecting section is provided with a plurality of ejecting trays which are independent from each other, the method further comprising:

controlling the conveyance section and the ejecting section, so that the paper sheet, with respect to which neither the primary abnormal state nor the secondary abnormal state is detected, is ejected onto one of the plurality of ejecting trays, while the jam-subsequent paper sheet, which is to be conveyed in the pre-purge processing, is ejected onto another one of the plurality of ejecting trays.

* * * * *